US007128542B2

(12) United States Patent
Suzuki et al.

(10) Patent No.: US 7,128,542 B2
(45) Date of Patent: Oct. 31, 2006

(54) VARIABLE DISPLACEMENT PUMP

(75) Inventors: Mikio Suzuki, Kariya (JP); Yoshiharu Inaguma, Kariya (JP); Keiji Suzuki, Kariya (JP); Hideya Kato, Kariya (JP); Tsuyoshi Ikeda, Kariya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 264 days.

(21) Appl. No.: 10/432,615

(22) PCT Filed: Dec. 3, 2001

(86) PCT No.: PCT/JP01/10531

§ 371 (c)(1),
(2), (4) Date: Nov. 21, 2003

(87) PCT Pub. No.: WO02/052155

PCT Pub. Date: Jul. 4, 2002

(65) Prior Publication Data

US 2004/0076536 A1 Apr. 22, 2004

(30) Foreign Application Priority Data

Dec. 4, 2000 (JP) ..... 2000-368906

(51) Int. Cl.
*F03C 2/00* (2006.01)
*F04C 2/00* (2006.01)
*F04C 15/04* (2006.01)

(52) U.S. Cl. ..... 418/26; 418/27; 418/30; 417/220

(58) Field of Classification Search ..... 418/26–30; 417/220

See application file for complete search history.

(56) References Cited

U.S. PATENT DOCUMENTS 5,090,881 A 2/1992 Suzuki et al.

(Continued)

FOREIGN PATENT DOCUMENTS

JP 11093856 A * 4/1999

(Continued)

OTHER PUBLICATIONS

U.S. Appl. No. 10/432,615, filed Jun. 4, 2003, Suzuki et al.

*Primary Examiner*—Theresa Trieu
(74) *Attorney, Agent, or Firm*—Oblon, Spivak, McClelland, Maier & Neustadt, P.C.

(57) ABSTRACT

In a hydraulic pump, a cam ring is provided in a cylindrical adaptor for movement in a radial direction, and a differential pressure control valve is provided to control internal pressure and load pressure at the front and back sides of a variable orifice to be introduced into action chambers and formed at the opposite sides of the cam ring for controlling a discharge amount of the pump in accordance with the rotation speed of the pump. The differential pressure control valve is operated under the internal pressure and load pressure respectively introduced into action chambers and the load of a thrust spring biasing the differential pressure control valve toward the internal pressure chamber. The load of the thrust spring is increased or decreased in accordance with an increase or a decrease of the load pressure. The increase or decrease of the load pressure is effected by a load pressure responsive piston loaded by a thrust spring and engaged with the differential pressure control valve at one end thereof in the internal pressure chamber.

5 Claims, 7 Drawing Sheets

U.S. PATENT DOCUMENTS 5,518,380 A * 5/1996 Fujii et al. ..... 418/26
5,562,432 A 10/1996 Semba et al.
6,375,441 B1 * 4/2002 Ichizuki et al. ..... 418/30

FOREIGN PATENT DOCUMENTS

JP 2000-170667 6/2000
JP 2000-170668 6/2000
JP 2002168181 A * 6/2002
JP 2003083265 A * 3/2003

* cited by examiner

VARIABLE DISPLACEMENT PUMP

FIELD OF THE INVENTION

The present invention relates to a hydraulic pump of the variable capacity type suitable for use in a power-assisted steering apparatus of an automotive vehicle, and more particularly to a hydraulic pump of the variable capacity type capable of controlling an amount of hydraulic fluid discharged therefrom in accordance with load pressure applied thereto.

DESCRIPTION OF THE PRIOR ART

Disclosed in Japanese Patent Publication No. 2(1990)-61638) is a hydraulic pump of the variable capacity type capable of controlling an amount of hydraulic fluid discharged therefrom in accordance with load pressure applied thereto. In the hydraulic pump, a cam ring is mounted within a housing body in such a manner as to be variable in its eccentric amount relative to the center of a rotor of a vane pump assembly and is loaded by a spring in an eccentric direction, a piston is provided to move the cam ring against the spring when operated by a difference in pressure between the front and back sides of an orifice in a discharge passage, and a hydraulic piston is provided to control an initial load of the spring when selectively applied with high pressure or low pressure under control of a changeover valve to be operated by an internal pressure applied from the front side of the orifice. In operation of the hydraulic pump, the discharge amount of the pump is controlled in accordance with the rotation speed of the pump in such a manner that the discharge amount of the pump does not increase when increased up to a limit value in response to increase of the rotation speed of the pump, and the limit value of the discharge amount is increased in accordance with an increase of load pressure to control the discharge characteristic of the pump in accordance with the load pressure. In the case that the limit value of the discharge amount is increased or decreased in accordance with increase or decrease of the load pressure in use of the hydraulic pump for a power-assisted steering apparatus of an automotive vehicle, a maximum value of the discharge amount of the pump is reduced in a condition where the steering apparatus is not operated during straight travel of the vehicle. This is useful to reduce consumption of energy without casing any influence to operation of the power-assisted steering apparatus.

In the hydraulic pump disclosed in Japanese Patent Publication No 2-61638, when the load pressure exceeds a predetermined value, a spool of the changeover valve is moved against the load of the spring to switchover a fluid passage. As a result, the hydraulic piston is moved by the internal pressure applied thereto under control of the changeover valve to vary the initial load of the spring acting on the cam ring. Accordingly, the cam ring is directly affected by the variation of the load of the spring. This causes the movement of the cam ring unstable. In addition, it is difficult to enhance the response for increase of the discharge amount of the pump relative to an increase of the load pressure.

SUMMARY OF THE INVENTION

To solve the foregoing problem, an object of the present invention is directed to provide a hydraulic pump wherein the load of a spring acting on a differential pressure control valve is increased in accordance with an increase of load pressure applied to the pump.

According to the present invention, the object is accomplished by providing a hydraulic pump of the variable capacity type which comprises a cam ring movable in a radial direction within a housing, a rotor mounted within the housing for rotation in the cam ring and supporting a plurality of circumferentially spaced vanes movable in a radial direction and slidably engaged with an internal surface of the cam ring, suction and discharge ports formed in the housing or a stationary member fixed in place in the housing and an orifice provided in a discharge passage communicating the discharge port to an outlet port, wherein first and second action chambers are formed on an outer circumference of the cam ring and opposed to each other in a movement direction of the cam ring, the cam ring is resiliently biased toward the first action chamber to maximize an eccentric amount relative to the rotor, wherein a differential pressure control valve is axially slidably disposed in a valve bore in the housing to control each pressure in the first and second action chambers, and wherein a thrust force of a spring acting on the differential pressure control valve is increased in accordance with an increase of load pressure.

As in the hydraulic pump of the variable capacity type, the thrust force of the spring acting on the differential pressure control valve is increased in accordance with an increase of load pressure, the operation of the differential pressure control valve changes in response to increase of the load pressure. Thus, when the eccentric amount of the cam ring starts to reduce, the rotation speed of the pump changes in such a manner as to vary the limit value of the discharge amount of the pump.

According to an aspect of the present invention, there is provided a hydraulic pump of the variable capacity type which comprises a cam ring movable in a radial direction within a housing, a rotor mounted within the housing for rotation in the cam ring and supporting a plurality of circumferentially spaced vanes movable in a radial direction and slidably engaged with an internal surface of the cam ring, suction and discharge ports formed in the housing or a stationary member fixed in place in the housing and an orifice provided in a discharge passage communicating the discharge port to an outlet port, wherein first and second action chambers are formed on an outer circumference of the cam ring and opposed to each other in a movement direction of the cam ring, and the cam ring is resiliently biased toward the first action chamber to maximize an eccentric amount relative to the rotor, wherein a differential pressure control valve is axially slidably disposed in a valve bore in the housing to form an internal pressure chamber and a load pressure chamber at its opposite ends, and wherein the internal pressure chamber and the load pressure chamber are respectively applied with internal pressure from the front side of the orifice and load pressure from the back side of the orifice such that a thrust force of a spring biasing the differential pressure control valve toward the internal pressure chamber against a force caused by a difference in pressure between the internal pressure chamber and the load pressure chamber is increased in accordance with an increase of the load pressure and that the differential pressure control valve introduces low pressure into the first action chamber when pressed toward the internal pressure chamber and introduces the internal pressure into the first action chamber and the load pressure into the second action chamber when moved toward the load pressure chamber.

As in the hydraulic pump, the internal pressure chamber and the load pressure chamber are formed at the opposite ends of the differential pressure control valve loaded by the thrust force of the spring toward the internal pressure chamber to be applied with the internal pressure and the load pressure from the front side and the back side of the orifice respectively, the eccentric amount of the cam ring is maximized when a difference of the internal pressure and the load pressure is small during rotation of the pump at a low speed. Thus, the discharge amount of the pump is rapidly increased in proportion to the rotation speed of the pump. When the differential pressure control valve is moved by an increase of the difference in pressure, the eccentric amount of the cam ring is reduced by a difference in pressure between the action chambers. As a result, the discharge amount of hydraulic fluid does not increase even if the rotation speed of the pump is increased. The thrust force of the spring acting on the differential pressure control valve is increase or decreased in accordance with an increase or a decrease of the load pressure applied from the back side of the orifice, and the difference in pressure acting on the differential pressure control valve against the thrust force of the spring is also increased or decreased in accordance with the increase or the decrease of the load pressure. Accordingly, when the eccentric amount of the cam ring is reduced by the difference in pressure between the action chambers, the rotation speed of the pump is increased or decreased. Thus, the limit value of the discharge amount of the pump is increased or decreased.

According to another aspect of the present invention, the hydraulic pump further includes a thrust spring biasing the differential pressure control valve toward the internal pressure chamber, a load pressure responsive piston slidably disposed within the housing to be engaged with one end of the differential pressure control valve at one end thereof in the internal pressure chamber, and a thrust spring biasing the load pressure responsive piston toward the differential pressure control valve. In such a case, the thrust force acting on the differential pressure control valve is defined by a difference of the thrust force of the spring biasing the differential pressure control valve toward the internal pressure chamber and the thrust force of the spring biasing the differential pressure control valve toward the load pressure chamber through the load pressure responsive piston.

DESCRIPTION OF THE PREFERRED EMBODIMENTS

Figure 1:
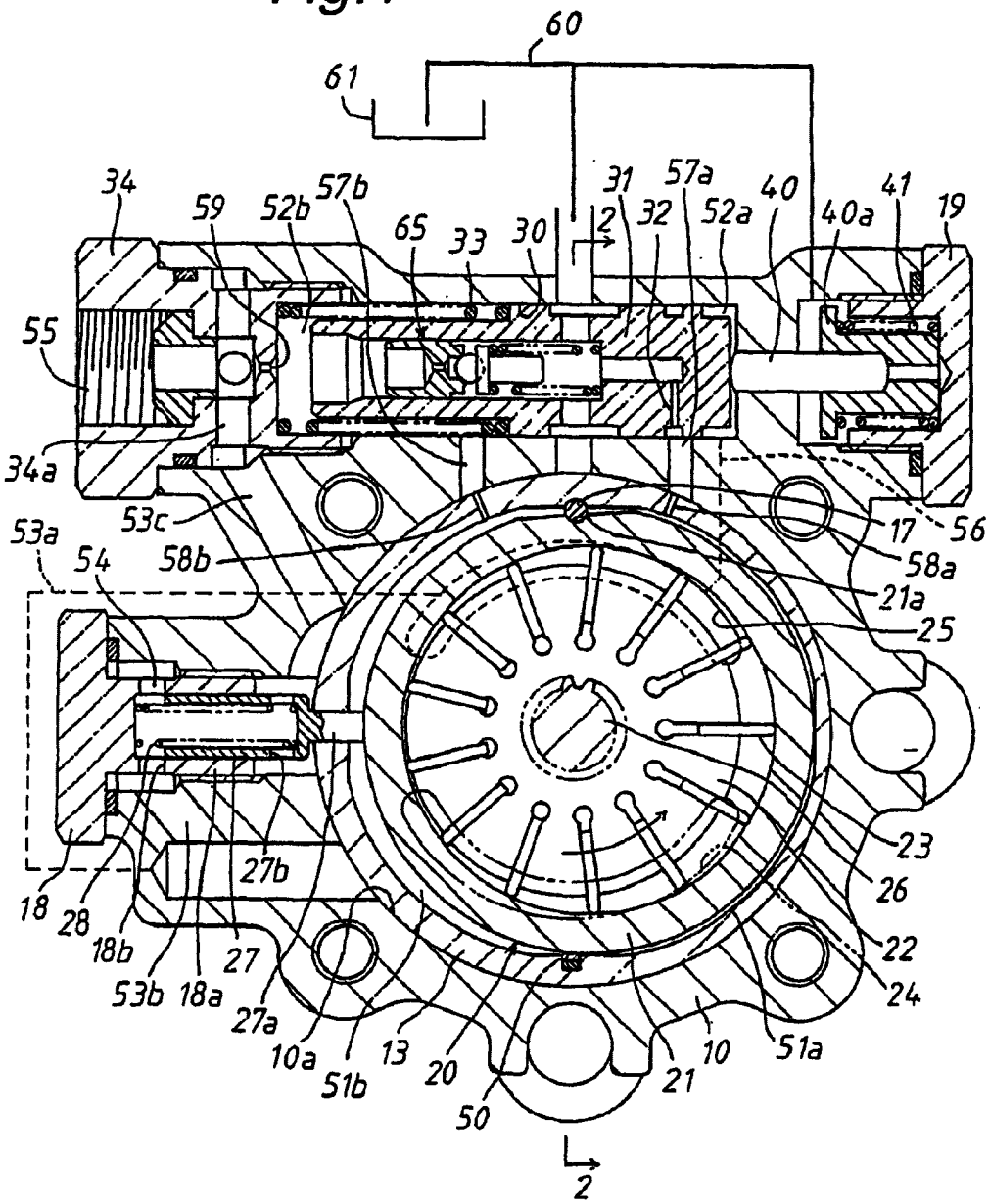
FIG. 1 is a cross-sectional view of a first embodiment of a hydraulic pump of the variable capacity type in accordance with the present invention.

Hereinafter, a first embodiment of a hydraulic pump in accordance with the present invention will be described with reference to FIGS. 1–4. The hydraulic pump of the variable capacity type is used as a supply source of hydraulic fluid for a power-assisted steering apparatus, the main components of which are composed of a housing 10 covered with an end wall member 11 in a liquid-tight manner, a pump shaft 26 mounted within the housing 10, a rotor 22 mounted on the pump shaft 26 for rotation therewith, a vane pump assembly 20 having a cam ring 21 movable in a radial direction, a differential pressure control valve 31 for controlling the movement of the cam ring 21, and a variable orifice 54 located in discharge passages 53*a*, 53*b* and 53*c*of the vane pump assembly 20.

Figure 2:
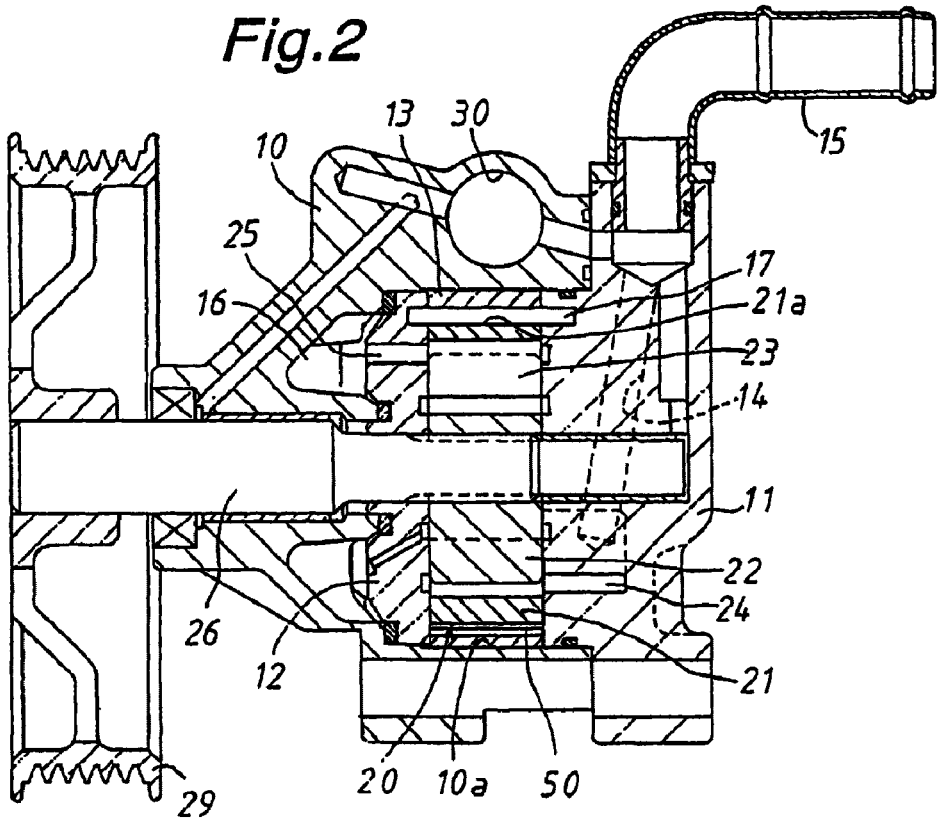
FIG. 2 is a sectional view taken along line 2—2 in FIG. 1.
Figure 3:
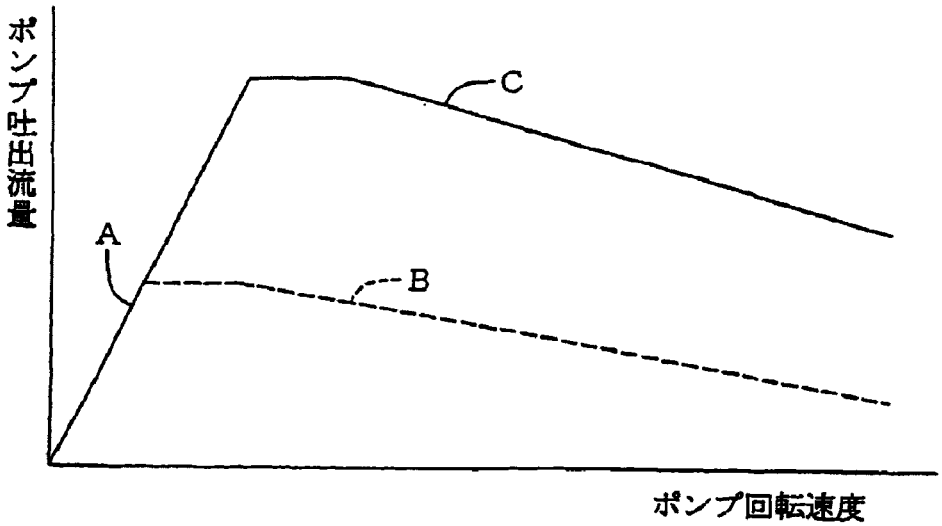
FIG. 3 is a graph showing a discharge characteristic of the hydraulic pump.

As shown in FIGS. 1 and 2, the pump shaft 26 is rotatably supported at its intermediate portion and rear end on the housing 10 and end wall member 11 respectively through a bearing. An internal cylindrical surface 10*a* is formed in the housing 10 concentrically with the pump shaft 26. A disc-like side plate 12 and a cylindrical adaptor 13 are fixedly coupled with the internal cylindrical surface 10*a* of housing 10. The vane pump assembly 20 is provided among the end wall member 11, disc-like side plate 12 and cylindrical adaptor 13 as described later. A v-grooved pulley 29 is mounted on an outer end of pump shaft 26 to be driven by a drive power transmitted from a prime mover of the vehicle.

The vane pump assembly 20 is composed of the cam ring 21 mounted within the cylindrical adaptor 13, the rotor 22 splined to an intermediate portion of the pump shaft 26 coaxially therewith, a plurality of circumferentially spaced vanes 23 slidably supported in a plurality of radial slits in the rotor 22 and maintained in engagement with an internal cylindrical surface of cam ring 21. These component parts 21–23 are retained at their side surfaces in slide contact with inner end surfaces of the end wall member 11 and side plate 12. A suction port 24 of the vane pump portion 20 is formed on the end face of end wall member 11 and communicated with a fluid reservoir 61 through a suction passage 14 and an inlet port 15 for supply of hydraulic fluid therefrom. A discharge port 25 is formed on the end face of side plate 12 and communicated with an outlet port 55 through discharge passages 53*a*, 53*b*, 53*c* and 34*a* to discharge fluid under pressure from a pressure chamber 16 through a variable orifice 54 described later in detail. As shown in FIG. 2, the pressure chamber 16 is formed in the housing at the backside of side plate 12.

A support pin 17 positioned in parallel with the pump shaft 26 is retained at its opposite ends on the end wall member 11 and side plate 12 and is engaged with an internal surface of cylindrical adaptor 13 at a portion of its outer periphery. The cam ring 21 is formed at a portion of its outer periphery with an axial recess 21*a* for engagement with the support pin 17 such that the cam ring 21 is movable in a radial direction. At a portion diametrically opposed to the axial recess 21*a*, the outer periphery of cam ring 21 is sealed by slidable engagement with a seal member 50 of tetrafluoroethylen which is backed up and disposed in an axial groove formed on the internal surface of cylindrical adaptor 13. Formed between the cylindrical adaptor 13 and cam ring 21 are first and second action chambers 51*a* and 51*b* which are subdivided by the support pin 17 and seal member 50 and opposed to one another in a movement direction of cam ring 21. A plug 18 located at the side of the second action chamber 51*b* is threaded into the peripheral wall of housing 10 in the movement direction of cam ring 21. A thrust piston 27 is slidably disposed in an internal cylindrical portion 18*a* of plug 18 for movement in an axial direction and loaded by a coil spring 28 in the axial direction of pump shaft 26. An inward projection 27*a* of thrust piston 27 is penetrated through a peripheral wall of the cylindrical adaptor 13 in a light-tight manner and engaged with the outer periphery of cam ring 21 to resiliently bias the cam ring 21 toward the first action chamber 51*a* in such a manner as to maximize an eccentric amount of cam ring 21 relative to the rotor 22.

The variable orifice 54 is in the form of radial holes 18*b* formed in a cylindrical portion 18*a* of plug 18 to be closed by a rear end of thrust piston 27. When the cam ring 21 is moved toward the second action chamber 51*b* to retract the thrust piston 27 against the coil spring 28, the radial holes 18*b* are gradually closed by the rear end of thrust piton 27 so that the opening area of radial hole 18*b* is reduced. The fluid under pressure from the vane pump portion 20 is discharged through the discharge passages 53*a*, 53*b* and variable orifice 54 and is further discharged from the outlet port 55 through radial holes 27*b* of thrust piston 27, discharge passage 53*c* and communication passage 34*a*. In a condition where the variable capacity pump is operated to discharge the fluid under pressure, the variable orifice 54 responds to a difference in pressure of the discharged fluid at its front and back sides. In such an instance, the pressure in the discharge passage 53*c*, communication passage 34*a* and outlet port 55 at the back side of variable orifice 54 becomes a load pressure applied in accordance with an operated condition of machinery supplied with the hydraulic fluid, while the pressure in the discharge passages 53*a*, 53*b* and pressure chamber 16 in front of the variable orifice 54 becomes an internal pressure of the pump larger than the load pressure. Thus, the internal pressure of the pump changes in accordance with variation of the load pressure. In a normally operated condition, the difference in pressure becomes a small value less than the internal pressure or load pressure.

As mainly shown in FIG. 1, the differential pressure control valve 31 is in the form of a spool valve 31 inserted from the left side in the figure into a valve bore 30 formed in the housing perpendicularly to the pump shaft 26 and coupled within the valve bore 30 to be movable in an axial direction. A union 34 is threaded into the left end of valve bore 30 and fixed in place to form action chambers 52*a*, 52*b* at the opposite ends of differential pressure control valve 31 in the housing 10. The union 34 has radial passages 34*a* for communicating the discharge passages 53*a*, 53*b* and 53*c* to the outlet port 55. The action chamber 52*a* located at the opposite side of union 34 is in the form of an internal pressure chamber that is applied with the internal pressure from the pressure chamber 16 through an introduction passage 56. The action chamber 52*b* located at the side of union 34 is in the form of a load pressure chamber that is applied with a load pressure from the outlet port 55 through a throttle passage 59. The differential pressure control valve 31 is loaded toward the internal pressure chamber 52*a* by means of a thrust coil spring 33 engaged with the union 34.

An introduction passage 57*a* formed in the housing 10 at the side of internal pressure chamber 52*a* is selectively communicated with the fluid reservoir 61 and the internal pressure chamber 52*a* in response to movement of the differential pressure control valve 31. In an inoperative condition where the differential pressure control valve 31 is retained in a distal end position of the valve bore 30 at the side of internal pressure chamber 52*a* under the load of coil spring 33, the introduction passage 57*a* is not communicated with the internal pressure chamber 52*a*. When the differential pressure control valve 31 is moved toward the load pressure chamber 52*b* against the load of coil spring 33, the introduction passage 57*a* is opened into the valve bore 30 at a position in communication with the internal pressure chamber 52*a*. The introduction passage 57*a* is in open communication with the first action chamber 51*a* through a damping orifice 58*a* formed in the cylindrical adaptor 13 at one side of the cam ring 21. A radial passage 32 formed in the differential pressure control valve 31 is communicated with the introduction passage 57*a* in a condition where the introduction passage 57*a* is blocked from the internal pressure chamber 52*a*. When the introduction passage 57*a* is communicated with the internal pressure chamber 52*a* in response to movement of the differential pressure control valve 31 toward the load pressure chamber 52*b*, the radial passage 32 is blocked from the introduction passage 57*a*. The radial passage 32 is constantly communicated with the fluid reservoir 61 through a communication conduit 60.

An introduction passage 57*b* formed in the housing 10 at the side of load pressure chamber 52*b* is in open communication with the load pressure chamber 52*b*. The introduction passage 57*b* is communicated with the second action chamber 51*b* through a damping orifice 58*b* formed in the cylindrical adaptor 13 at the other side of cam ring 21. A pilot relief valve 65 is assembled in an axial bore of differential pressure control valve 31 to relief the pressure in load pressure chamber 52*b* into the fluid reservoir 61 when the load pressure increases in excess so that the differential pressure control valve 31 is moved toward the load pressure chamber 52*b* to minimize an amount of hydraulic fluid discharged from the pump.

A load pressure responsive piston 40 smaller in diameter than the differential pressure control valve 31 is slidably disposed in a portion of housing 10 coaxially with the valve bore 30 at the side of internal pressure chamber 52*a* and is engaged at one end thereof with the differential pressure control valve 31. A thrust coil spring 41 is disposed between a spring receiver 40*a* fixed to the other end of load pressure responsive piston 40 and a plug 19 threaded into the housing 10. In a condition where the internal pressure in chamber 52*a* is lower than a predetermined value, the load pressure responsive piston 40 is maintained in engagement with the differential pressure control valve 31 under load of the coil spring 41 and loaded toward the load pressure chamber 52*b*. The thrust force of coil spring 41 is determined to be smaller than that of thrust coil spring 33.

Figure 4:
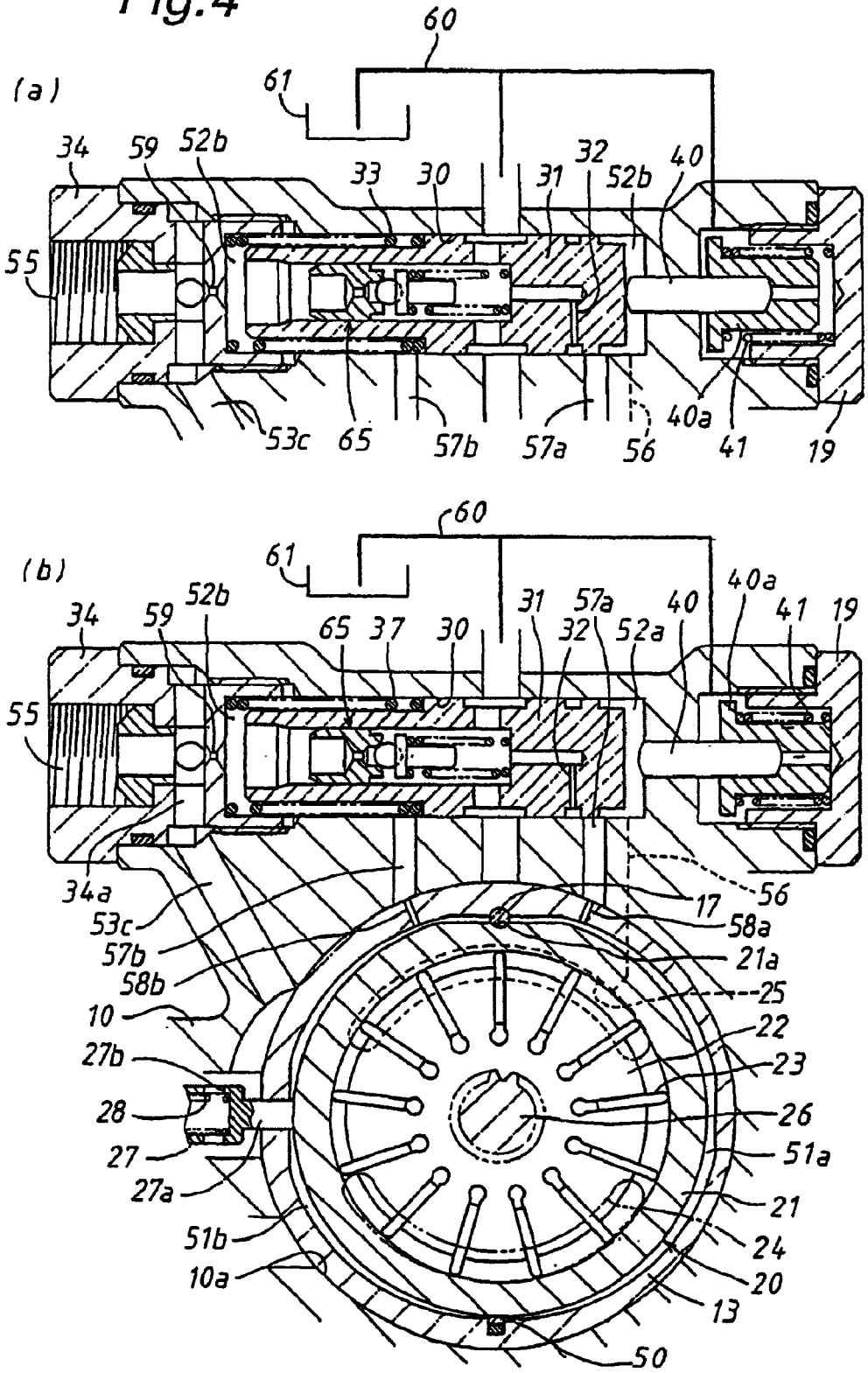
FIGS. 4(*a*) and 4(*b*) illustrate, in a partial section, operated conditions of the hydraulic pump shown in FIG. 1.

The thrust force of the spring biasing the differential pressure control valve 31 against a leftward force caused by a difference in pressure between the action chambers 52*a* and 52*b* corresponds with a difference between the thrust force of spring 33 and the thrust force of spring 41 applied to the differential pressure control valve 31 through the load pressure responsive piston 40. Thus, the thrust force of coil spring 33 is not influenced by the internal pressure and load pressure in chambers 52*a* and 52*b*. When the internal pressure in action chamber 52*a* is zero, the differential pressure control valve 31 is applied with the thrust force of coil spring 41 through the load pressure responsive piston 40. When the internal pressure in action chamber 52*a* increases against the thrust force of coil spring 41 more than a predetermined pressure, the load pressure responsive piston 40 is disengaged from the differential pressure control valve 31 as shown in FIG. 4(*b*), and the thrust force of coil spring 41 applied to the differential pressure control valve 31 through the load pressure responsive piston 40 becomes zero. Thus, the thrust force of the spring biasing the differential pressure control valve 31 toward the internal pressure chamber 52*a* against the leftward force caused by the difference in pressure between the action chambers 52*a* and 52*b* increases in accordance with an increase of the load pressure. In an inoperative condition where the load pressure is zero, the differential pressure control valve 31 is pressed in contact with the distal end of valve bore 30 in the internal pressure chamber 52*a*.

When the rotor 22 of the vane pump is rotated by rotation of a prime mover of the vehicle transmitted to the pump shaft 26 through a drive belt stretched over the v-grooved pulley 29, hydraulic fluid in reservoir 61 is sucked into each space between the vanes 23 through the inlet port 15, passage 14 and suction port 24, discharged into the pressure chamber 16 from the discharge port 25 and supplied to a machinery such as a power-assisted steering apparatus through the discharge passages 53*a*, 53*b*, 53*c* with the variable orifice 54 and discharge passage 34*a*.

When a small amount of hydraulic fluid flows through the discharge passages 53*a*, 53*b*, 53*c* during rotation of the pump at a low speed, the difference in pressure between front and backsides of the variable orifice 54 is still in a small value. In such an instance, the differential pressure control valve 31 is maintained in contact with the distal end of valve bore 30 in the internal pressure chamber 52*a* under the load of thrust coil spring 33 as shown in FIG. 1 so that the first action chamber 51*a* is communicated with the fluid reservoir 61 through the introduction passage 57*a* and radial passage 32 to render the pressure in first action chamber 51*a* zero. Thus, the cam ring 21 is pressed toward the first action chamber 51 under the load of thrust coil spring 28 to maximize the discharge amount of hydraulic fluid. In such a condition, the amount of hydraulic fluid discharged from the outlet port 55 through the discharge passages 53*a*, 53*b*, 53*c* and communication passage 34*a* rapidly increases in accordance with an increase of rotation speed of the pump as shown by a characteristic line A in FIG. 3.

When the difference in pressure between the front and back sides of variable orifice 54 increases in accordance with an increase of the discharge amount of hydraulic fluid, the difference in pressure between the internal pressure chamber 52*a* and load pressure chamber 52*b* increases to cause an increase of the thrust force acting on the differential pressure control valve 31 toward the load pressure chamber 52*b*. In a condition where the load pressure is still low (in a condition where the steering wheel of the vehicle is not operated), the load pressure responsive piston 40 is maintained in engagement with the differential pressure control valve 31 under the load of thrust coil spring 41. In such an instance, the differential pressure control valve 31 is applied with a relatively small thrust force caused by a difference between the loads of thrust coil springs 33 and 41.

Accordingly, the differential pressure control valve 31 is moved by a difference in pressure between the front and back sides of the variable orifice 54 caused by a relatively small discharge amount of hydraulic fluid so that the first action chamber 51*a* is communicated with the internal pressure chamber 52*a* as shown in FIG. 4(*a*). As a result, the eccentric amount of cam ring 21 is reduced to maintain the difference in pressure between the front and back sides of variable orifice 54 in a constant amount, and the discharge amount of the pump is maintained in a small amount as shown by a characteristic line B in FIG. 3. This is useful to restrain consumption of energy. In addition, the discharge amount of the pump is decreased in accordance with an increase of rotation speed of the pump since the throttle area of variable orifice 54 is reduced in accordance with a decrease of the eccentric amount of cam ring 21.

Assuming that the load pressure is increased by operation of the steering wheel in such operation of the pump as described above, the load pressure responsive piston 40 is moved by the internal pressure in action chamber 52*a* against the load of thrust coil spring 41 and is disengaged from the differential pressure control valve 31 as shown in FIG. 4(*b*). In such an instance, a relatively large spring load of thrust coil spring 33 acts on the differential pressure control valve 31. Thus, if the difference in pressure between the front and back sides of variable orifice 54 or the discharge amount of the pump does not increase, the first action chamber 51*a* may not be communicated with the internal pressure chamber 52*a*. As a result, as shown by a characteristic line C in FIG. 3, the discharge amount of the pump is increased to an amount necessary for assisting the operation of the steering wheel.

In such operation of the pump, variation of the spring load acting on the differential pressure control valve 31 caused by increase or decrease of the load pressure does not directly affect to the cam ring 21. This is useful to enhance the stability in operation of the cam ring 21. In addition, the spring load acting on the differential pressure control valve 31 is increased in accordance with an increase of the load pressure, and each pressure in the first and second action chambers 51*a* and 51*b* is directly controlled by movement of the differential pressure control valve 31 to vary the eccentric amount of cam ring 21. This is also useful to enhance the response of increase or decrease of the discharge amount of the pump relative to increase or decrease of the load pressure.

In this first embodiment, the spring load acting on the differential pressure control valve 31 is varied by disengagement from the load pressure responsive piton 40 or engagement therewith. Thus, the spring load is varied in accordance with the load pressure without causing any stroke of the differential pressure control valve 31. This is useful to enhance the response to changeover of the discharge amount characteristics B and C caused by increase or decrease of the load pressure.

Hereinafter, a second embodiment of the present invention will be described with reference to FIGS. 5 to 7. In this second embodiment, a thrust spring 33A and a load pressure responsive spool 45 are provided to bias the differential pressure control valve 31 toward the internal pressure chamber 52*a* against a rightward thrust force caused by a difference in pressure between the internal pressure chamber 52*a* and the load pressure chamber 52*b*. As the other construction is substantially the same as those in the first embodiment, only a different point will be described below.

Figure 5:
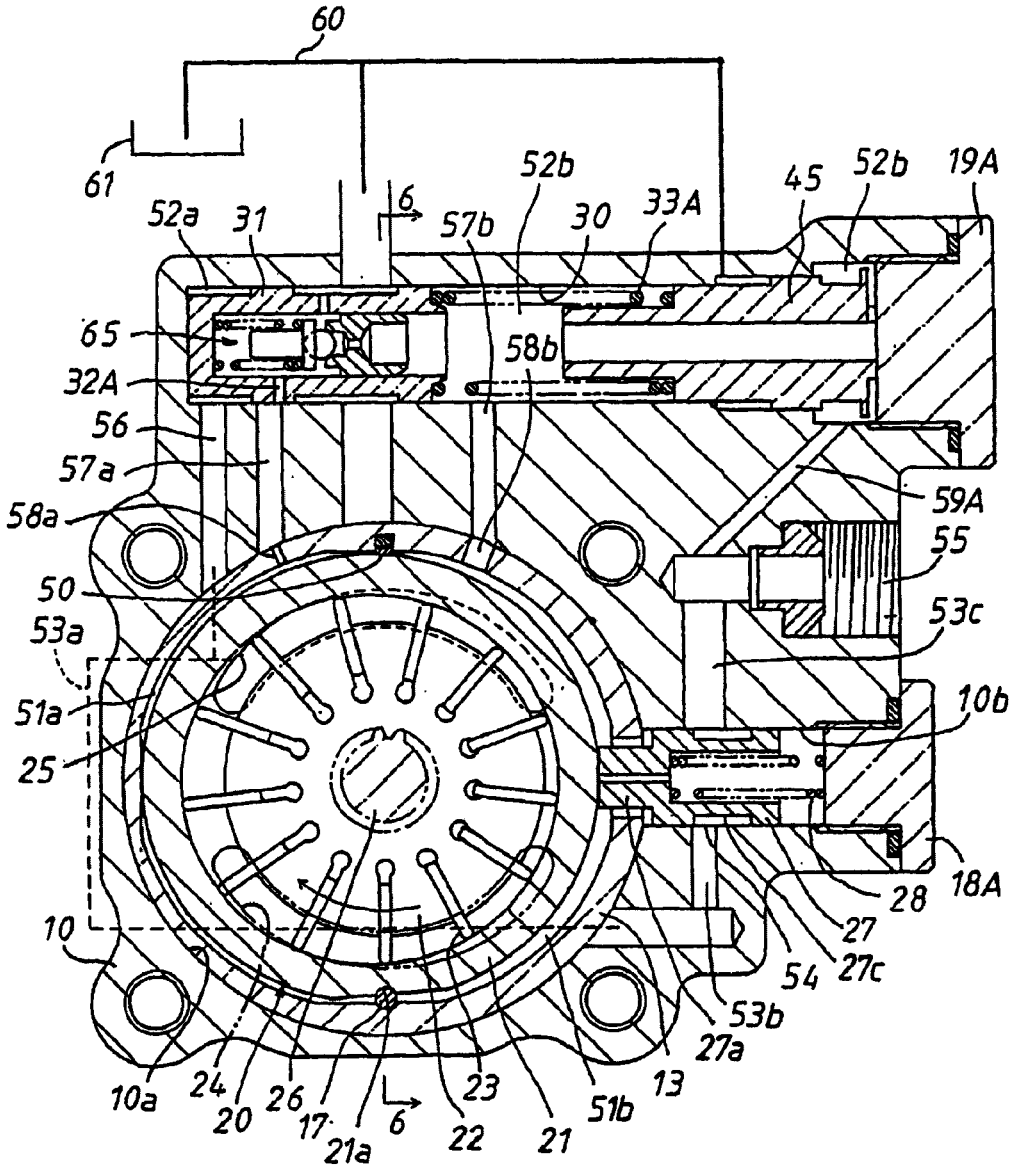
FIG. 5 is a cross-sectional view of a second embodiment of a hydraulic pump of the variable capacity type in accordance with the present invention.
Figure 6:
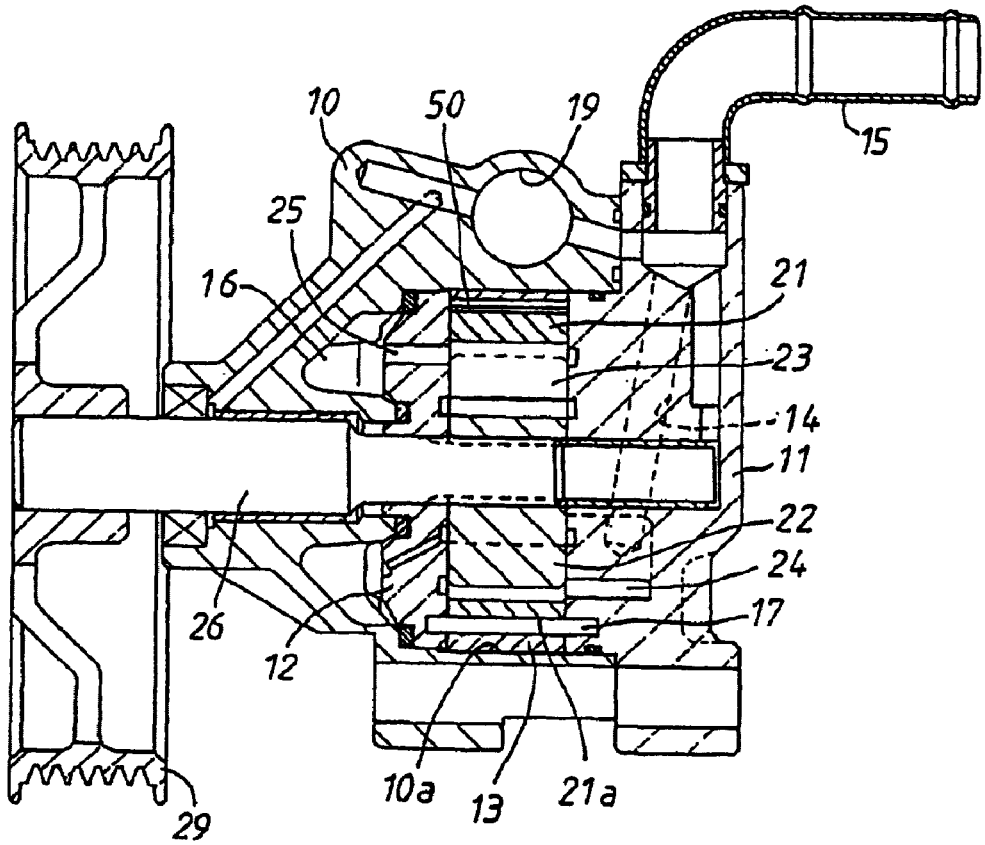
FIG. 6 is a sectional view taken along line 6—6 in FIG. 5.

As shown mainly in FIG. 5, the valve bore 30 in housing 10 is opened at its right side and closed by a plug 19A. The differential pressure control valve 31 and load pressure responsive spool 45 are axially slidably disposed in the valve bore 30 through the thrust spring 33A. The action chambers 52*a* and 52*b* are formed at the opposite sides of differential pressure control valve 31 in the housing 10. The action chamber 52*b* formed at the inside of plug 19A is in the form of a load pressure chamber applied with load pressure from an outlet port 55 through a communication passage 59A, while the action chamber 52*a* formed at the opposite side is in the form of an internal pressure chamber applied with internal pressure from the pressure chamber 16 through the passage 56 for introduction of internal pressure of the pump.

The load pressure responsive spool 45 and thrust spring 33A are placed in the load pressure chamber 52*b*, and an axial hole is formed in the load pressure responsive spool 45 for fluid communication at its opposite ends. A portion of valve bore 30 forming the load pressure chamber 52*b* is in the form of a stepped bore formed in small diameter at the side of differential pressure control valve 31 and in large diameter at the inside of plug 19A. The load pressure responsive spool 45 is slidably disposed in the stepped bore. An annular space formed around the load pressure responsive spool 45 in the stepped bore is communicated with the fluid reservoir 61 through the communication conduit 60.

In the same manner as in the first embodiment, radial communication passages 32A formed in the differential pressure control valve 31 are communicated with the fluid reservoir 61 through the communication conduit 60. With the radial communication passages 32A, the introduction passage 57*a* in communication with the first action chamber 51*a* is selectively communicated with the fluid reservoir 61 and the internal pressure chamber 52*a* in response to axial movement of the differential pressure control valve 31. The introduction passage 57*b* in communication with the second action chamber 51*b* is constantly communicated with the load pressure chamber 52*b*. The differential pressure control valve 31 is further provided therein with a pilot relief valve 65. The thrust piston 27 is slidably disposed in a cylindrical axial bore 10*b* in the housing 10 to bias the cam ring 21 toward the first action chamber 51*a* under the load of thrust coil spring 28 received by a plug 18A. The variable orifice 54 is formed by an annular groove 27*c* of thrust piston 27 and the discharge passage 53*b*, and the outlet port 55 is formed in the housing 10.

Figure 7:
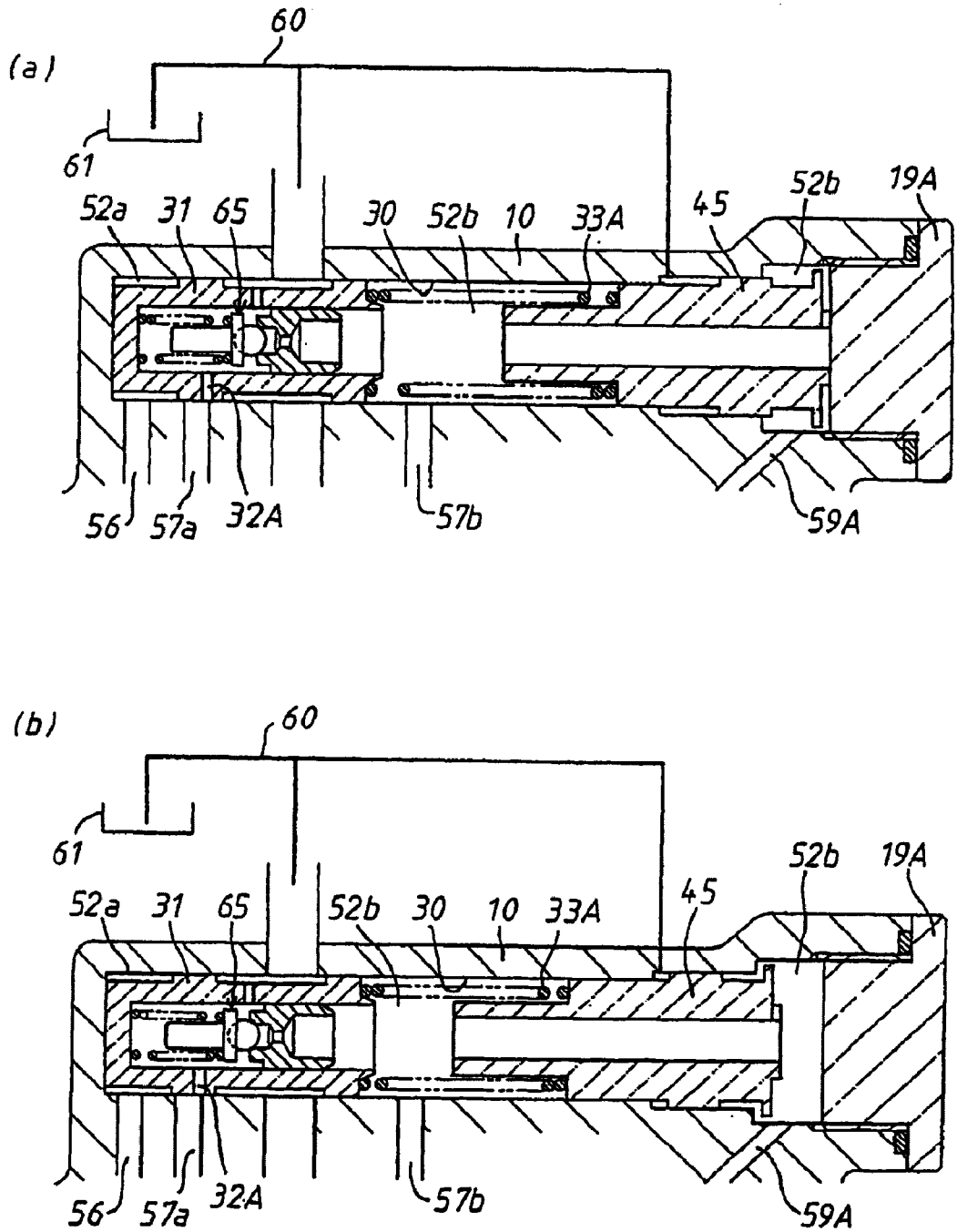
FIGS. 7(*a*) and 7(*b*) illustrate, in a partial section, operated conditions of the hydraulic pump shown in FIG. 5.

As the cross-sectional area of the stepped load pressure responsive spool 45 at the side of plug 19A is larger than that at the side of thrust spring 33A, the responsive spool 45 is retained in engagement with the plug 19A in a condition where the load pressure in chamber 52*b* is zero or in a predetermined low value, as shown in FIGS. 5 and 7(*a*). When the load pressure in chamber 52*b* increases more than the predetermined value, the responsive spool 45 moves toward the differential pressure control valve 31 as shown in FIG. 7(*b*), and the thrust spring 33A is compressed by the movement of responsive spool 45 to cause an increase of its initial load. As a result, the thrust force biasing the differential pressure control valve 31 toward the internal pressure chamber 52*a* increases against a rightward thrust force caused by a difference in pressure between action chambers 52*a* and 52*b* and applied to the differential pressure control valve 31.

In this second embodiment, a difference in pressure between the front and back sides of variable orifice 54 is maintained in a small value in a condition where the pump is rotated at a low speed. Thus, as shown in FIG. 5, the differential pressure control valve 31 is maintained in contact with the distal end of valve bore 30 in the internal pressure chamber 52*a* under the load of thrust coil spring 33A so that the first action chamber 51*a* is communicated with the fluid reservoir 61 and that the cam ring 21 is pressed toward the first action chamber 51*a* under the load of thrust coil spring 28 to maximize the amount of hydraulic fluid discharged from the pump. In such a condition, the discharge amount of hydraulic fluid rapidly increases in accordance with an increase of rotation speed of the pump, as shown by the characteristic line A in FIG. 3.

When the difference in pressure between the front and back sides of variable orifice 54 increases in accordance with an increase of the discharge amount of hydraulic fluid, the thrust force acting on the differential pressure control valve 31 toward the load pressure chamber 52*b* increases in accordance with an increase of the difference in pressure. When the thrust force acting on the differential pressure control valve 31 exceeds the load of thrust coil spring 33A, the differential pressure control valve 31 starts to move toward the load pressure chamber 52*b*. When the introduction passage 57*a* is blocked from the radial passage 32A and communicated with the first action chamber 51*a*, the internal pressure at the front side of variable orifice 54 is applied to the first action chamber 51*a*. Thus, as in the first embodiment, the discharge amount of hydraulic fluid does not increase more than a limited value as shown by the characteristic lines B and C in FIG. 3 even if the rotation speed of the pump increases. As in this second embodiment, the opening area of variable orifice 54 is reduced in accordance with the movement of cam ring 21, the discharge amount of hydraulic fluid decreases in accordance with an increase of the rotation speed of the pump. This is useful to provide a hydraulic pump of the variable capacity type suitable for a power-assisted steering apparatus.

When the internal pressure increases in accordance with an increase of the load pressure, the thrust force of spring 33A acting on the differential pressure control valve 31 toward the internal pressure chamber 52*a* increases in accordance with an increase of the internal pressure as described above. Accordingly, if the internal pressure in chamber 52*a* is low in a condition where the pump is operated as in the first embodiment as shown by the characteristic line A in FIG. 3, the differential pressure control valve 31 starts to move toward the load pressure chamber 52*b* when the discharge amount of hydraulic fluid is still relatively small, and the introduction passage 57*a* is communicated with the internal pressure chamber 52*a* in response to movement of the differential pressure control valve 31 so that the eccentric amount of cam ring 21 starts to reduce. As a result, the limit value of the discharge amount of the pump becomes low as shown by the characteristic line B in FIG. 3. Contrarily, if the internal pressure in chamber 52*a* becomes high, the differential pressure control valve 31 starts to move toward the load pressure chamber 52*b* after increase of the discharge amount of the pump, and the introduction passage 57*a* is communicated with the internal pressure chamber 52*a* so that the eccentric amount of cam ring 21 starts to reduce. As a result, the limit value of the discharge amount of the pump becomes high. As the limit value rises in accordance with an increase of the internal pressure as described above, the limit value of the discharge amount becomes maximum as shown by the characteristic line C when the load pressure responsive spool 45 is moved to its stroke end. Thus, the characteristic of the discharge amount is controlled in accordance with the load pressure applied to the pump.

In this second embodiment, the difference in pressure between the action chambers 51*a* and 51*b* is controlled in accordance with the load pressure for adjustment of the eccentric amount of cam ring 21 without controlling the initial load of thrust spring 28 in accordance with the load pressure. With such adjustment of the cam ring 21, the spring constant of thrust spring 33A acting on the differential pressure control valve 31 is increased without causing any delay in rapid variation of the load pressure. As a result, even if variation of the difference in pressure increases at the variable orifice 54, oscillation phenomenon of the cam ring 21 can be restrained by appropriate setting of the damping orifice 58*a* for enhancement of dampening action of hydraulic fluid.

Although in this second embodiment, the axial hole is formed in the center of load pressure responsive spool 45 so that the same load pressure is applied to the opposite sides of spool 45, a communication passage may be formed in the housing 10 in an appropriate manner to apply the same load pressure to the opposite sides of spool 45.

Hereinafter, a third embodiment of the present invention will be described with reference to FIG. 8. In this third embodiment, a thrust coil spring 33B and a load pressure responsive portion 37 are provided to bias a differential pressure control valve 35 toward the internal pressure chamber 52*a* against a rightward thrust force caused by a difference in pressure between the action chambers 52*a* and 52*b*. As the other construction is substantially the same as those in the first embodiment, only a different point will be described below.

Figure 8:
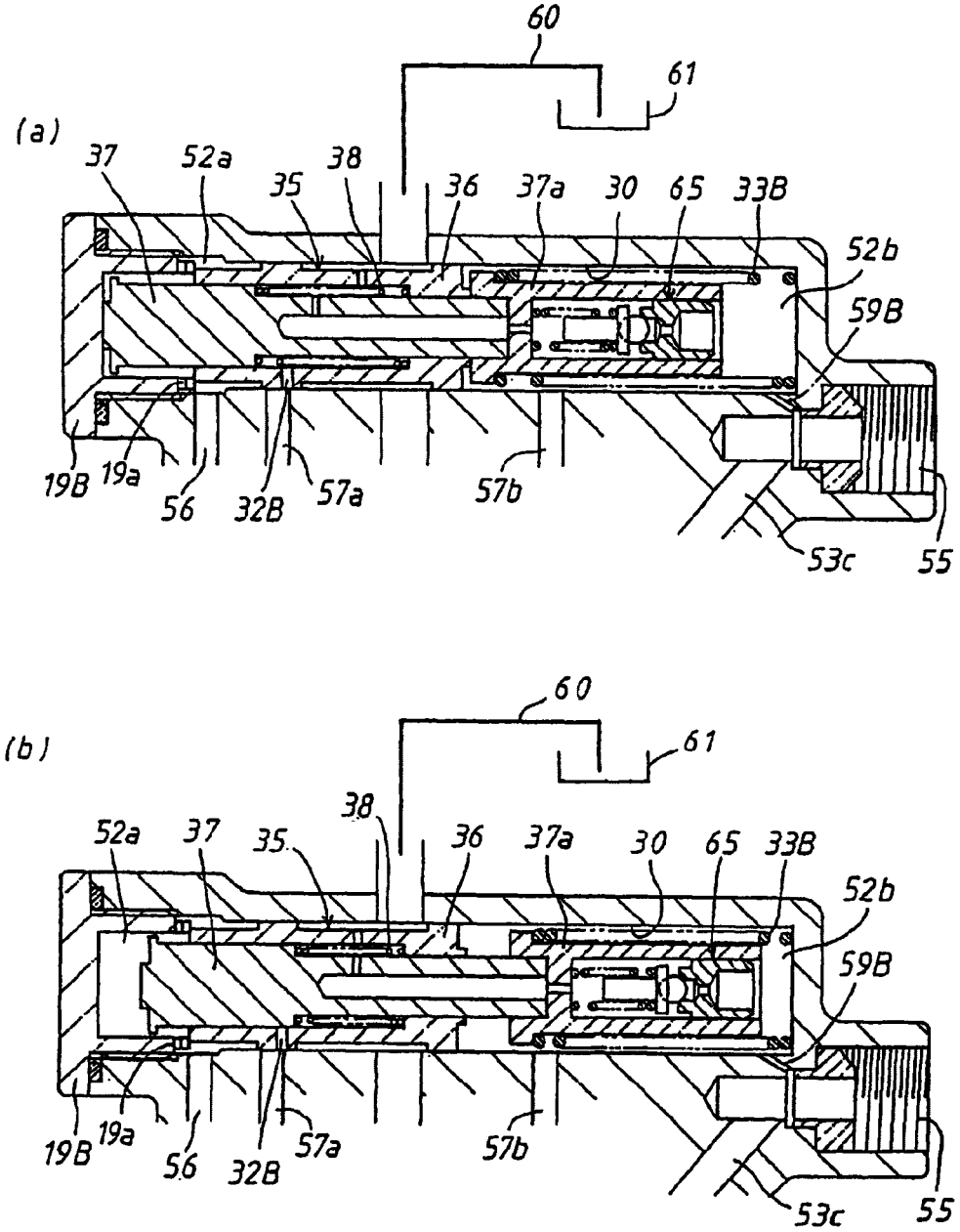
FIGS. 8(*a*) and 8(*b*) illustrate, in a partial section, a main portion of a third embodiment of a hydraulic pump of the variable capacity type in accordance with the present invention and operated conditions of the hydraulic pump.

As shown in FIG. 8, the valve bore 30 in housing 10 is opened at its left side and closed by a plug 19B. The differential pressure control valve 35 composed of plural components is axially slidably disposed in the valve bore 30. The action chambers 52*a* and 52*b* are formed at the opposite sides of differential pressure control valve 35 in the housing 10. The action chamber 52*a* formed at the inside of plug 19B is in the form of an internal pressure chamber applied with internal pressure from the pressure chamber 16 through the introduction passage 56, while the action chamber 52*b* formed at the opposite side is in the form of a load pressure chamber applied with load pressure from an outlet port 55 through a communication passage 59B.

The differential pressure control valve 35 is composed of a cylindrical portion 36 axially slidably disposed in the valve bore 30, the load pressure responsive portion 37 axially slidably disposed in an axial bore of the cylindrical portion 36 and fixed to a spring receiver 37*a* larger in diameter than the axial bore, and a valve spring 38 biasing the cylindrical portion 36 toward the spring receiver 37*a*. The axial bore of the cylindrical portion 36 is in the form of a stepped bore which is formed in small diameter at the side of spring receiver 37*a* and in large diameter at the opposite side. The load pressure responsive portion 37 is disposed in the stepped bore of cylindrical portion 36, and the valve spring 38 is disposed in an annular space between the cylindrical portion 36 and load pressure responsive portion 37. The annular space is communicated with the fluid reservoir 61 through the radial passages 32B and communication conduit 60.

The differential pressure control valve 35 is biased toward the internal pressure chamber 52*a* by means of the thrust coil spring 33B interposed between the inner end of valve bore 30 and the spring receiver 37*a*. Under the load of thrust coil spring 33B, the cylindrical portion 36 and spring receiver 37*a* are engaged with each other at their one ends, and the cylindrical portion 36 and load pressure responsive portion 37 are engaged with an internal cylindrical portion and an internal bottom of plug 19B. The internal cylindrical portion of plug 19B is formed at its distal end with radial holes 19*a* for communication between the interior and exterior thereof.

In the same manner as in the first and second embodiments, the cylindrical portion 36 of differential pressure control valve 35 is formed with the radial passages 32B for communicating the annular space with the fluid reservoir 61 through the communication conduit 60. Thus, the introduction passage 57*a* in communication with the first action chamber 51*a* is selectively communicated with the fluid reservoir 61 and the internal pressure chamber 52*a* in response of movement of the cylindrical portion 36 of differential pressure control valve 35. The load pressure introduction passage 57*b* in communication with the second action chamber 51*b* is constantly communicated with the load pressure chamber 52*b*. The spring receiver 37*a* is provided therein with a pilot relief valve 65.

When the load pressure and internal pressure increase from zero and exceed a predetermined value, the load pressure responsive portion 37 disposed in the axial bore of cylindrical portion 36 is moved toward the load pressure chamber 52*b* against the load of valve spring 38 in a condition where the cylindrical portion 36 is maintained in engagement with the internal cylindrical portion of plug 19B. As a result, the thrust spring 33B disposed between the spring receiver 37*a* and the inner wall of housing 10 is compressed to increase the initial load acting on the spring receiver 37*a* as shown in FIG. 8(*b*). Thus, the thrust force of spring 33B biasing the differential pressure control valve 35 toward the internal pressure chamber 52*a* against the rightward force caused by a difference in pressure between chambers 52*a* and 52*b* increases in accordance with an increase of the load pressure and internal pressure.

In this third embodiment, the difference in pressure between the front and back sides of variable orifice 54 (shown in FIG. 5) is small during rotation of the pump at a low speed. In such an instance, the differential pressure control valve 35 is pressed into contact with the distal end of internal pressure chamber 52*a* under the load of thrust spring 33B as shown in FIG. 8(*a*), and the cylindrical portion 36 is maintained in engagement with the spring receiver 37*a* under the load of valve spring 38. Thus, the first action chamber 51*a* is applied with low pressure from the fluid reservoir 61 so that the cam ring 21 is pressed toward the first action chamber 51*a* under the load of thrust spring 28 to maximize the discharge amount of the pump. Accordingly, the discharge amount of the pump rapidly increases in response to an increase of the rotation speed of the pump as shown the characteristic line A in FIG. 3.

When the difference in pressure between the front and back sides of variable orifice 54 increases in response to an increase of the discharge amount of the pump, the differential pressure control valve 35 starts to move toward the load pressure chamber 52*b* against the load of spring 33B thereby to block the introduction passage 57*a* from the radial passage 32B and communicate the same with the first action chamber 51*a*. In such an instance, the first action chamber 51*a* is applied with the internal pressure from the front side of variable orifice 54. Accordingly, even if the rotation speed of the pump increases in accordance with an increase of the load pressure, the discharge amount of the pump does not increase more than the limited values as shown by the characteristic lines B and C in FIG. 3. Thus, the discharge amount characteristic of the pump is controlled in accordance with the rotation speed of the pump. As in this third embodiment, the opening area of variable orifice 54 is reduced in accordance with decrease of the discharge amount of the pump, the discharge amount of hydraulic fluid decreases in accordance with an increase of the rotation speed of the pump. This is useful to provide a hydraulic pump of the variable capacity type suitable for a power-assisted steering apparatus.

When the load pressure and internal pressure increase, the thrust force of spring 33B acting on the differential pressure control valve 35 toward the internal pressure chamber 52*a* increases as described above. Accordingly, if the load pressure and internal pressure are low in a condition where the pump is operated as in the first and second embodiments as shown by the characteristic line A in FIG. 3, the differential pressure control valve 35 starts to move toward the load pressure chamber 52*b* when the discharge amount of the pump is still relatively small, and the introduction passage 57*a* is communicated with the internal pressure chamber 52*a* in response to movement of the differential pressure control valve 35 so that the eccentric amount of cam ring starts to reduce. As a result, the limit value of the discharge amount of the pump becomes low as shown by the characteristic line B in FIG. 3. Contrarily, if the load pressure and internal pressure are increased, the differential pressure control valve 35 starts to move toward the load pressure chamber 52*b* after increase of the discharge amount of the pump, and the introduction passage 57*a* is communicated with the internal pressure chamber 52*a* so that the eccentric amount of cam ring 21 starts to reduce. As a result, the limit value of the discharge amount of the pump becomes high. As the limit value rises in accordance with an increase of the load pressure and internal pressure, the limit value of the discharge amount becomes maximum as shown by the characteristic line C when the load pressure responsive portion 37 is moved to its stroke end. Thus, the discharge characteristic of the pump is controlled in accordance with the load pressure applied thereto.

In this third embodiment, the difference in pressure between the action chambers 51*a* and 51*b* is controlled in accordance with the load pressure for adjustment of the eccentric amount of cam ring 21 without controlling the initial load of thrust spring 28 in accordance with the load pressure. With such adjustment of the cam ring 21, the spring constant of thrust spring 33B acting on the differential pressure control valve 35 is increased without causing any delay to rapid variation of the load pressure. As a result, even if variation of the difference in pressure at the variable orifice 54 becomes large, oscillation phenomenon of the cam ring 21 can be restrained by appropriate setting of the damping orifice 58*a* for enhancement of dampening action of hydraulic fluid. Accordingly, a hydraulic pump of the variable capacity type can be provided without causing any delay in response and unstableness in discharge amount.

Although in the foregoing embodiments, the cam ring 21 is retained by the support pin 17 for movement in a radial direction, the cam ring 21 may be supported on the internal cylindrical surface of adaptor 13 at positions of the support pin 17 and seal member 50 in a liquid-tight manner for movement in a radial direction.

In the present invention, the load of the thrust spring acting on the differential control valve for control of each pressure in the first and second action chambers is increased in accordance with an increase of load pressure for adjustment of the eccentric amount of the cam ring. With such adjustment of the eccentric amount of the cam ring, it is able to enhance stability in operation of the cam ring and to enhance response in increase or decrease of the discharge amount of the pump relative to increase or decrease of the load pressure.

In the case that the load pressure responsive piston is to be engaged with one end of the differential pressure control valve in the internal pressure chamber as in the present invention, the spring force acting on the differential pressure control valve is varied in accordance with the load pressure without causing any stroke of the differential pressure control valve. This is useful to further enhance the response for increase or decrease of the discharge amount of the pump relative to increase or decrease of the load pressure.

The invention claimed is:

1. A hydraulic pump of the variable capacity type, comprising:

a cam ring movable in a radial direction within a housing, a rotor mounted within the housing for rotation in the cam ring and supporting a plurality of circumferentially spaced vanes movable in a radial direction and slidably engaged with an internal surface of the cam ring, suction and discharge ports formed in the housing or a stationary member fixed in place in the housing and an orifice provided in a discharge passage communicating the discharge port to an outlet port, first and second action chambers formed on an outer circumference of the cam ring and opposed to each other in a movement direction of the cam ring, wherein the cam ring is resiliently biased toward the first action chamber to maximize an eccentric amount relative to the rotor, a differential pressure control valve axially slidably disposed in a valve bore in the housing to control each pressure in the first and second action chambers, and means for providing that spring forces acting on both sides of the differential pressure control valve have more than one value for a single position in said valve bore of said differential pressure control valve.

2. A hydraulic pump of the variable capacity type, comprising:

a cam ring movable in a radial direction within a housing, a rotor mounted within the housing for rotation in the cam ring and supporting a plurality of circumferentially spaced vanes movable in a radial direction and slidably engaged with an internal surface of the cam ring, suction and discharge ports formed in the housing or a stationary member fixed in place in the housing and an orifice provided in a discharge passage communicating the discharge port to an outlet port, first and second action chambers are formed on an outer circumference of the cam ring and opposed to each other in a movement direction of the cam ring, wherein the cam ring is resiliently biased toward the first action chamber to maximize an eccentric amount relative to the rotor, a differential pressure control valve axially slidably disposed in a valve bore in the housing to form an internal pressure chamber and a load pressure chamber at its opposite ends, and means for providing that spring forces acting on both sides of the differential pressure control valve have more than one value for a single position in said valve bore of said differential pressure control valve, wherein the internal pressure chamber and the load pressure chamber are respectively applied with internal pressure from a front side of the orifice and load pressure from a back side of the orifice such that the differential pressure control valve introduces low pressure into the first action chamber when pressed toward the internal pressure chamber and introduces the internal pressure into the first action chamber and the load pressure into the second action chamber when moved toward the load pressure chamber.

3. A hydraulic pump of the variable capacity type as set forth in claim 2, wherein the orifice is in the form of a variable orifice whose opening area is reduced in accordance with movement of the cam ring toward the second action chamber.

4. A hydraulic pump of the variable capacity type comprising:

a cam ring movable in a radial direction within a housing, a rotor mounted within the housing for rotation in the cam ring and supporting a plurality of circumferentially spaced vanes movable in a radial direction and slidably engaged with an internal surface of the cam ring, suction and discharge ports formed in the housing or a stationary member fixed in place in the housing and an orifice provided in a discharge passage communicating the discharge port to an outlet port, wherein first and second action chambers are formed on an outer circumference of the cam ring and opposed to each other in a movement direction of the cam ring, and the cam ring is resiliently biased toward the first action chamber to maximize an eccentric amount relative to the rotor, wherein a differential pressure control valve is axially slidably disposed in a valve bore in the housing to form an internal pressure chamber and a load pressure chamber at its opposite ends, and wherein the internal pressure chamber and the load pressure chamber are respectively applied with internal pressure from a front side of the orifice and load pressure from a back side of the orifice such that a thrust force of a spring biasing the differential pressure control valve toward the internal pressure chamber against a force caused by a difference in pressure between the internal pressure chamber and the load pressure chamber is increased in accordance with an increase of the load pressure and the differential pressure control valve introduces low pressure into the first action chamber when pressed toward the internal pressure chamber and introduces the internal pressure into the first action chamber and the load pressure into the second action chamber when moved toward the load pressure chamber, a thrust spring biasing the differential pressure control valve toward the internal pressure chamber, a load pressure responsive piston slidably disposed within the housing to be engaged with one end of the differential pressure control valve at one end thereof in the internal pressure chamber, and a thrust spring biasing the load pressure responsive piston toward the differential pressure control valve, wherein the thrust force acting on the differential pressure control valve is defined by a difference of the thrust force of the spring biasing the differential pressure control valve toward the internal pressure chamber and the thrust force of the spring biasing the differential pressure control valve toward the load pressure chamber through the load pressure responsive piston.

5. A hydraulic pump of the variable capacity type as set forth in claim 4, wherein the orifice is in the form of a variable orifice whose opening area is reduced in accordance with movement of the cam ring toward the second action chamber.

* * * * *